US007635282B2

(12) United States Patent
Sakamoto

(10) Patent No.: US 7,635,282 B2
(45) Date of Patent: Dec. 22, 2009

(54) COAXIAL CABLE SHIELDING TERMINAL WITH IMPROVED PRESS-CLAMPING PORTION

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/246,245

(22) Filed: Oct. 6, 2008

(65) Prior Publication Data

US 2009/0098769 A1 Apr. 16, 2009

(30) Foreign Application Priority Data

Oct. 12, 2007 (JP) ..... 2007-266648

(51) Int. Cl.
*H01R 9/05* (2006.01)

(52) U.S. Cl. ..... 439/578; 439/585

(58) Field of Classification Search ..... 439/578, 439/585, 877

See application file for complete search history.

(56) References Cited

U.S. PATENT DOCUMENTS 3,539,976 A * 11/1970 Reynolds ..... 439/585
3,660,805 A * 5/1972 McDonough ..... 439/585
4,598,961 A * 7/1986 Cohen ..... 439/63
5,316,506 A * 5/1994 Ito ..... 439/879
6,808,417 B2 * 10/2004 Yoshida ..... 439/585
2004/0203286 A1 * 10/2004 Kameyama ..... 439/585
2005/0266727 A1 * 12/2005 Yamaguchi et al. ..... 439/585
2007/0249225 A1 * 10/2007 Sakaguchi et al. ..... 439/578

FOREIGN PATENT DOCUMENTS

JP 2003-133005 A 5/2003
JP 2004-319175 A 11/2004

* cited by examiner

*Primary Examiner*—Hae Moon Hyeon
(74) *Attorney, Agent, or Firm*—Sughrue Mion, PLLC

(57) ABSTRACT

A coaxial cable shielding terminal includes a cylindrical inner terminal accommodating portion, an insertion portion and a press-clamping portion. The cylindrical inner terminal accommodating portion accommodates an inner terminal connected to a conductor core. The insertion portion extends from an end of the inner terminal accommodating portion, and is inserted into between a braided shield and an insulating cladding at an exposed area of the braided shield. The press-clamping portion is provided separately from the insertion portion, and press-clamps the exposed area of the braided shield so that the braided shield is sandwiched by the insertion portion and the press-clamping portion. A concave portion or a convex portion is provided on at least one of an outer surface of the insertion portion and an inner surface of the press-clamping portion to sandwich the braided shield.

4 Claims, 4 Drawing Sheets

COAXIAL CABLE SHIELDING TERMINAL WITH IMPROVED PRESS-CLAMPING PORTION

CROSS-REFERENCES TO RELATED APPLICATIONS

The present application claims priority from Japan Patent Application No. 2007-266648 filed on Oct. 12, 2007, the contents of which are incorporated herein by reference.

BACKGROUND

The present invention relates to a coaxial cable shielding terminal electrically connected to a braided shield exposed at a terminal end of a coaxial cable.

Generally, in order to shield a coaxial cable used as an antenna wire or the like from electrical noises, such as electromagnetic waves and static electricity, the coaxial cable is constructed such that a conductor core covered with an insulating cladding, that the insulating cladding is covered with a braided shield, and that the braided shield is covered with an insulating sheath. Further, various coaxial connectors for connecting such a coaxial cable to a mating device or a mating connector have been proposed. Furthermore, such a coaxial connector uses a coaxial cable shielding terminal for the ground connection of the braided shield of the coaxial cable to an appropriate grounding portion. FIG. 8 illustrates an example of such a coaxial cable shielding terminal (see, e.g., Patent Document 1).

A coaxial cable 133 illustrated in FIG. 8 is constructed as follows. That is, an end portion of each of an insulating sheath 139, a braided shield 135, and an insulating cladding 138 is peeled off such that the braided shield 135, the insulating cladding 138, and a conductor core 137 are exposed by a predetermined length. Then, an inner terminal 141 for the fitting-connection of the conductor core 137 to a mating connector is attached to the conductor core 137.

The coaxial cable shielding terminal 131 illustrated in FIG. 8 is obtained by performing press-working on one metal sheet. The coaxial cable shielding terminal 131 has a cylindrical terminal body 143 that accommodates an inner terminal 141 of the coaxial cable 133 on the central axis thereof, a terminal bottom plate portion 144 extending from one end of the terminal body 143, a pair of press-clamping pieces 151 that are respectively erected from both side edges of the terminal bottom plate portion 144 and that press-clamp the braided shield 135, a pair of crimping pieces 153 that are erected from both side edges of the terminal bottom plate portion 144 and that crimp the insulating sheath 139, and an insertion piece 155 which extends from one end of the terminal body 143 to face the terminal bottom plate portion 144 and is cross-sectionally shaped like a circular arc plate extending along the inner circumferential surface of the braided shield 135, and which is inserted into between the insulating cladding 138 and the braided shield 135.

The coaxial cable shielding terminal 131 of the configuration crimps the press-clamping piece 151 onto the braided shield 135 in a state in which the insertion piece 155 is inserted from the terminal end side of the coaxial cable 133 into between the insulating cladding 138 and the braided shield 135. Thus, the coaxial cable shielding terminal 131 sandwiches a part of the braided shield 135 between the insertion piece 155 and a distal end of the press-clamping piece 151. Consequently, the braided shield 135 and the coaxial cable shielding terminal 131 are electrically connected to each other. Further, the coaxial cable shielding terminal 131 is electrically connected to an appropriate grounding portion. Thus, the braided shield 135 is earth-connected to the grounding portion.

[Patent Document 1] JP-A-2004-319175

However, the conventional coaxial cable shielding terminal 131 has a problem in that the holding force of the press-clamping piece 151, which is applied to the braided shield 135, is low, so that the braided shield 135 press-clamped to the press-clamping piece 151 is displaced, and that the braided shield 135 slips off between the press-clamping piece 151 and the insertion piece 155.

In order to address this problem, a crimping load at the press-clamping of the braided shield 135 by crimping the press-clamping piece 151 is increased. Thus, the holding force applied to the braided shield 135 can be increased. However, this brings in a new problem that the conductor core 137 is pressed, so that the conductor core 137 may be broken or deformed. Thus, it is easy to increase the holding force of the press-clamping piece 151, which is exerted onto the braided shield 135, by maintaining good high-frequency characteristics of the coaxial cable 133.

SUMMARY

Accordingly, an object of the invention is to provide a coaxial cable shielding terminal capable of press-clamping a braided shield with a high holding force without breaking and deforming a conductor core of a coaxial cable.

To achieve the foregoing object, according to the invention, there is provided a coaxial cable shielding terminal for attaching to a coaxial cable having a conductor core which is covered by an insulating cladding, the insulating cladding being covered by a braided shield, and the braided shield being covered by an insulating sheath, the coaxial cable shielding terminal comprising:

a cylindrical inner terminal accommodating portion that accommodates an inner terminal connected to the conductor core;

an insertion portion that extends from an end of the inner terminal accommodating portion, and is inserted into between the braided shield and the insulating cladding at an exposed area of the braided shield; and a press-clamping portion that is provided separately from the insertion portion, and that press-clamps the exposed area of the braided shield so that the braided shield is sandwiched by the insertion portion and the press-clamping portion, wherein a concave portion or a convex portion is provided on at least one of an outer surface of the insertion portion and an inner surface of the press-clamping portion to sandwich the braided shield.

Preferably, one of the concave portion and the convex portion is provided on the outer surface of the insertion portion. The other of the concave portion and the convex portion is provided on the inner surface of the press-clamping portion. The concave portion and the convex portion are engaged to each other.

Preferably, the insertion portion has a cylindrical shape.

By the above configuration, even in a case where a crimping load is increased when the braided shield is press-clamped by crimping the press-clamping portion, the insertion portion protects the conductor core by surrounding the whole circumference of the insulating cladding. Consequently, the braided shield can be press-clamped with a high holding force without breaking and deforming a conductor core of a coaxial cable. In addition, the concave portion or the convex portion is provided on at least one of an outer surface of the insertion portion and an inner surface of the press-clamping portion. Thus, due to an edge effect by which the braided shield is dug into the concave portion or the convex portion and is engaged with an edge of one end part of each of the concave portion or the convex portion, the braided shield is prevented from being displaced with respect to the press-clamping portion. Consequently, a holding force to be applied to the braided shield can be enhanced.

Also, the concave portion and the convex portions are provided on both an outer surface of the insertion portion and an inner surface of the press-clamping portion to engage each other. Thus, the braided shield is more deeply dug into the concave portion and the convex portions. Consequently, the braided shield is more effectively prevented from being displaced with respect to the press-clamping portion. Accordingly, the holding force to be applied to the braided shield can be further enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
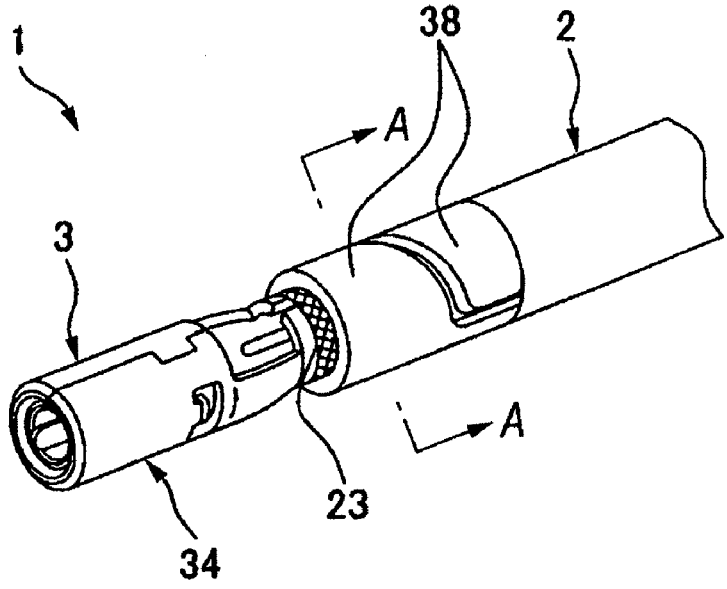
FIG. 1 is a perspective view illustrating a state in which a coaxial cable shielding terminal according to an embodiment of the invention is attached to a terminal of a coaxial cable.
Figure 2:
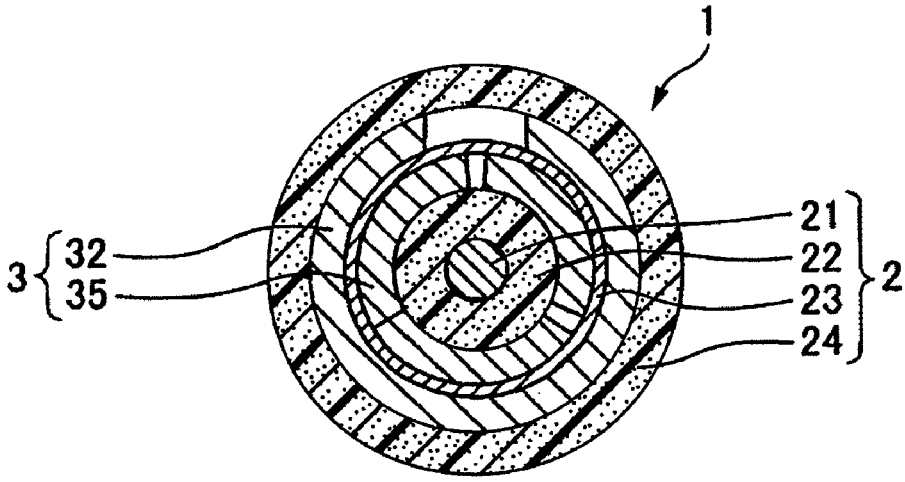
FIG. 2 is a cross-sectional view taken along line A-A illustrated in FIG. 1.
Figure 3:
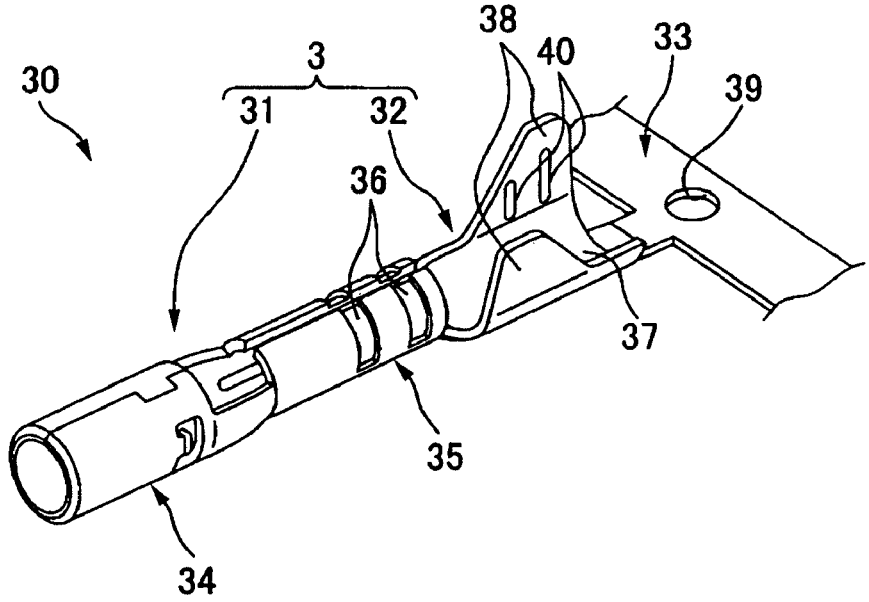
FIG. 3 is a perspective view illustrating a metal material of which the coaxial cable shielding terminal illustrated in FIG. 1 is formed.
Figure 4:
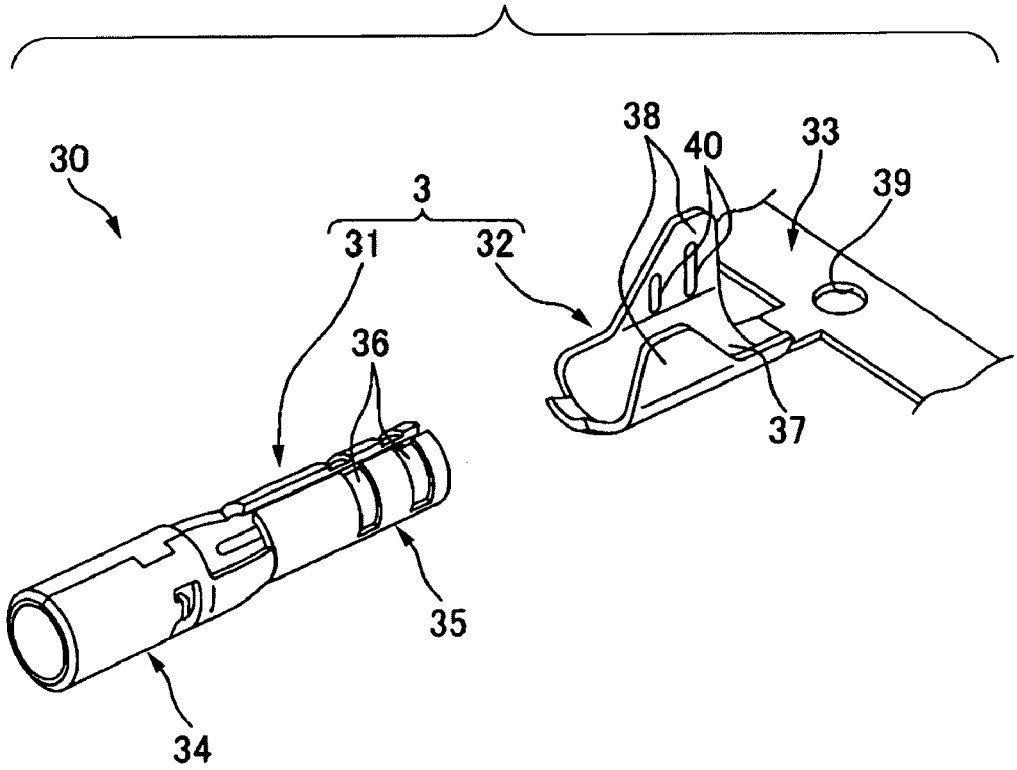
FIG. 4 is a perspective view illustrating a state in which an insertion portion is separated from a press-clamping portion in the metal material illustrated in FIG. 3.
Figure 5:
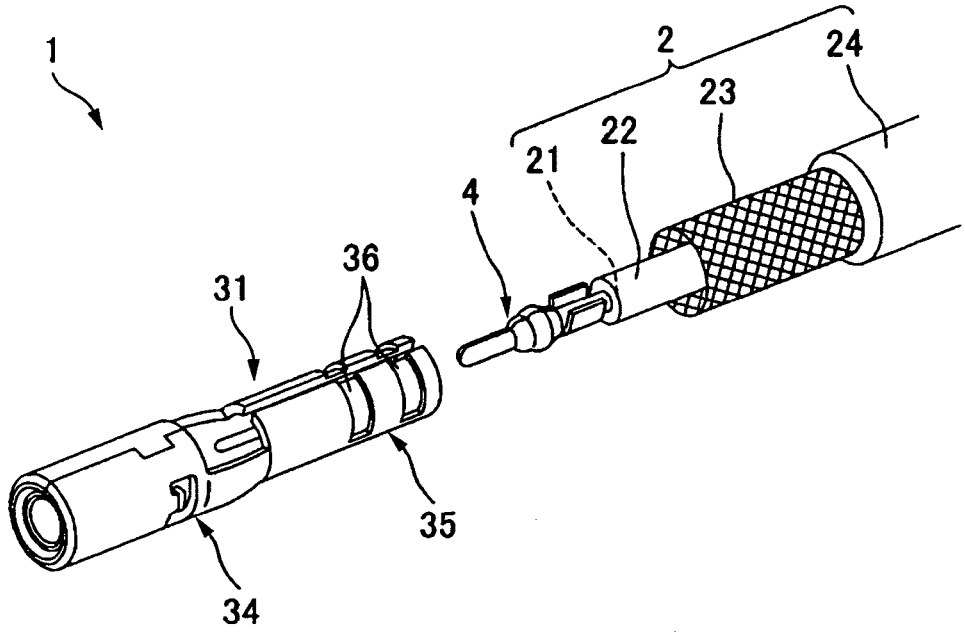
FIG. 5 is a perspective view illustrating a condition in which the insertion portion illustrated in FIG. 4 is inserted into between an insulating cladding and a braided shield of the coaxial cable.
Figure 6:
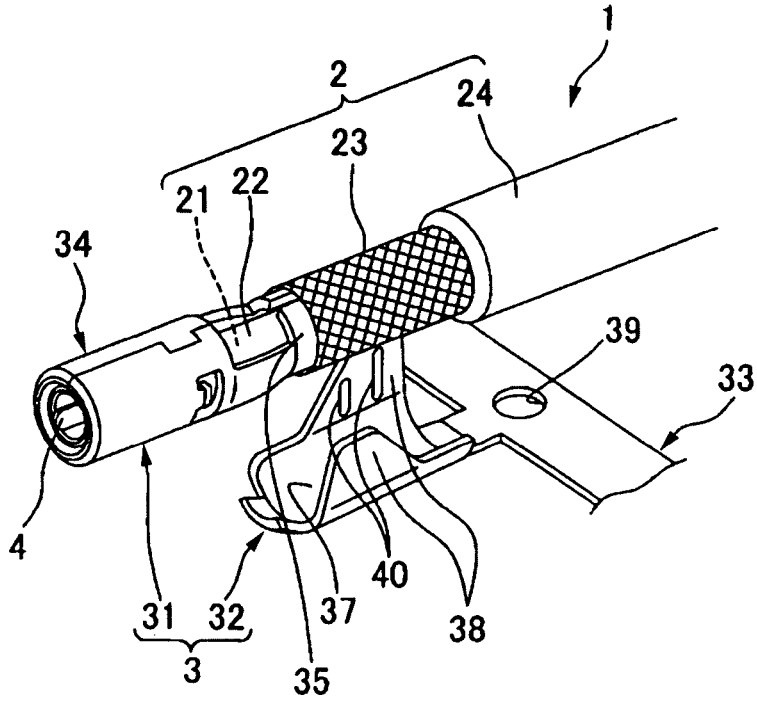
FIG. 6 is a perspective view illustrating a condition in which the press-clamping portion illustrated in FIG. 4 press-clamps the braided shield to sandwich the braided shield between the press-clamping portion and the insertion portion illustrated in FIG. 5.

A coaxial cable shielding terminal according to an embodiment of the invention is described below with reference to FIGS. 1 to 6. FIG. 1 is a perspective view illustrating a state in which a coaxial cable shielding terminal according to the embodiment of the invention is attached to a terminal end of a coaxial cable. FIG. 2 is a cross-sectional view taken along line A-A illustrated in FIG. 1. FIG. 3 is a perspective view illustrating a metal material of which the coaxial cable shielding terminal illustrated in FIG. 1 is formed. FIG. 4 is a perspective view illustrating a state in which an insertion portion is separated from a press-clamping portion in the metal material illustrated in FIG. 3. FIG. 5 is a perspective view illustrating a condition in which the insertion portion illustrated in FIG. 4 is inserted into between an insulating cladding and a braided shield of the coaxial cable. FIG. 6 is a perspective view illustrating a condition in which the press-clamping portion illustrated in FIG. 4 press-clamps the braided shield to sandwich the braided shield between the press-clamping portion and the insertion portion illustrated in FIG. 5.

A coaxial cable shielding terminal (hereunder referred to as a shielding terminal) 3 according to an embodiment of the invention is attached to a terminal end of a coaxial cable 2 and constitutes a coaxial cable with a terminal 1 illustrated in FIG. 1. That is, the shielding terminal 3 according to the invention is electrically connected to a braided shield 23 of the coaxial cable 2. Consequently, the braided shield 23 is earth-connected to an appropriate grounding portion. In addition, an inner terminal 4 attached to a conductor core 21 of the coaxial cable 2 is electrically shielded by being covered. Incidentally, the "appropriate grounding portion" is, e.g., an electrically conductive connector housing (not shown) or a metallic case (not shown), which accommodates the shielding terminal 3.

The coaxial cable 2 is an electric cable through which a high-frequency signal is transmitted. As illustrated in FIG. 5, the coaxial cable 2 is configured to include an electrically conductive conductor core 21 that transmits a high-frequency signal, a synthetic resin insulating cladding 22 that covers the conductor core 21, an electrically conductive braided shield 23 that covers the insulating cladding 22 and that prevents electric noise from occurring on the conductor core 21, and a synthetic resin insulating sheath 24 that covers the braided shield 23.

Further, the insulating sheath 24 is peeled off at the terminal end of the coaxial cable 2, so that a part of the braided shield 23 is exposed. A press-clamping portion 32 of the shielding terminal 3, which will be described below, is press-clamped to the exposed part of the braided shield 23. A male inner terminal 4 is connected to the conductor core 21 that extends closer to the terminal side of the coaxial cable 2 than the exposed part of the braided shield 23 and that has an end portion which is exposed by peeling off the insulating cladding 22 therefrom. The inner terminal 4 is fit into a female terminal of the mating connector (not shown), so that a high-frequency signal is transmitted to the female terminal. Incidentally, according to the invention, the inner terminal 4 can be of the female type.

The shielding terminal 3 is formed of a metal material 30 obtained by punching an electrically conductive metal sheet into a predetermined shape and then folding the metal sheet, as illustrated in FIG. 3. The metal material 30 is provided such that a plurality of connection elements, in each of which the body portion 31 and the press-clamping portion 32 constituting the shielding terminal 3 are connected to each other, are provided on a band-like carrier 33 by being arranged in parallel at intervals. Incidentally, FIG. 3 illustrates only one connection element and omits other plural connection elements.

Such a metal material 30 is constructed so that the connection elements are sequentially fed onto a transport mechanism by engaging positioning pins and feed claws in transport holes 39 formed in the carrier 33 to penetrate therethrough. Further, the body portion 31 is separated from the press-clamping portion 32 by a cutting device provided on the transport mechanism, as illustrated in FIG. 4. Then, the insertion portion 35 of the body portion 31 is inserted into between the insulating cladding 22 and the exposed portion of the braided shield 23 from the terminal end side of the coaxial cable 2, as illustrated in FIG. 5. Subsequently, a press-clamping device provided on the transport mechanism causes the press-clamping portion 32 to press-clamp the exposed portion of the braided shield 23 such that the exposed portion of the braided shield 23 is sandwiched between the press-clamping portion 32 and the insertion portion 35, as illustrated in FIG. 6. Simultaneously with this, the press-clamping portion 32 is separated from the carrier 33. Thus, the shielding terminal 3 is attached to the coaxial cable 2. Finally, the coaxial cable with the terminal 1 illustrated in FIG. 1 is assembled.

Next, the configuration of each of the body portion 31 and the press-clamping portion 32 constituting the shielding terminal 3 is described in detail below.

The body portion 31 includes a cylindrical inner terminal accommodating portion 34 that electrically shields the inner terminal 4 connected to the conductor core 21 of the coaxial cable 2 by coaxially accommodating the inner terminal 4, and an insertion portion 35 which cylindrically extends from one end of the inner terminal accommodating portion 34 and which is inserted into between an exposed portion of the braided shield 23 exposed at a terminal end of the coaxial cable 2 and the insulating cladding 22 (see FIG. 2). Further, the inner terminal 4 is accommodated in an inner space of the inner terminal accommodating portion 34 by inserting the insertion portion 35 into between the exposed portion of the braided shield 23 and the insulating cladding 22 from an end portion of the body portion, which is at the side distant from the inner terminal accommodating portion 34.

The insertion portion 35 is formed to be smaller in diameter than the inner terminal accommodating portion 34, and surrounds the whole circumference of the insulating cladding 22. Also, recess grooves 36, which are formed concavely to extend from the outer surface of the insertion portion 35 to the central axis thereof along the circumferential direction of the insertion portion 35, are provided on the outer peripheral surface of the insertion portion 35, i.e., a surface of the insertion portion, which is contacted with the inner peripheral surface of the braided shield 23. The recess grooves 36 are provided by performing embossing on a steel plate that is in a flat state before the insertion portion 35 is cylindrically bent.

The press-clamping portion 32 is provided separately from the body portion 31. The press-clamping portion 32 has a bottom plate portion 37 which is formed in a substantially plate-like shape in plan view and is bent like a curved surface extending along the surface of the insertion portion 35, and a pair of press-clamping pieces 38 erected respectively from both side edges of the bottom plate portion 37. Further, projection portions 40, each of which is so formed as to project from the outer surface of an associated one of the pair of press-clamping pieces 38 to the inner surface thereof and as to extend from the bottom plate portion 37 to a distal end portion of the associated one of the press-clamping pieces 38, are respectively provided on the inner surfaces of the pair of press-clamping pieces 38, i.e., surfaces the pair of press-clamping pieces 38, which are contacted with the braided shield 23. The projection portions 40 are provided by performing embossing on the steel plate in a state in which the steel plate is flat before the press-clamping portion 32 is bent like a U-shape.

Such a press-clamping portion 32 press-clamps the exposed portion of the braided shield 23 to position the exposed portion of the braided shield 23 on the bottom plate portion 37 in a state, in which the insertion portion 35 is inserted into between the exposed portion of the braided shield 23 and the insulating cladding 22, and to sandwich the exposed portion of the braided shield 23 between the press-clamping portion 32 and the insertion portion 35 by winding the pair of press-clamping pieces 38 around the exposed portion of the braided shield 23. Consequently, the braided shield 23 is electrically connected to the insertion portion 35. In addition, the braided shield 23 is mechanically fixed to the insertion portion 35 by the press-clamping portion 32. Further, the braided shield 23 is earth-connected to a grounding portion (not shown) by electrically connecting the shielding terminal 3 to the grounding portion.

Further, when the press-clamping portion 32 is press-clamped, the insertion portion 35 is preliminarily put into a state in which the insertion portion 35 is inserted into between the exposed portion of the braided shield 23 and the insulating cladding 22. Then, the press-clamping portion 32 press-clamps the exposed portion of the braided shield 23 from an outer side, i.e., an external side of the insertion portion 35. Thus, even when a crimping load for crimping the pair of press-clamping pieces 38 is increased, the insertion portion 35 protects the conductor core 21 of the coaxial cable 2. Consequently, the braided shield 23 can be press-clamped with a high holding force without breaking and deforming a conductor core 21 of a coaxial cable.

Additionally, when the press-clamping portion 32 is press-clamped, the press-clamping portion 32 is crimped by being overlapped with the exposed portion of the braided shield 23 such that the projection portions 40 of the pair of press-clamping pieces 38 are engaged with the recess grooves 36 of the insertion portion 35, respectively. Thus, the braided shield 23 is sandwiched between the projection portions 40 and the recess grooves 36. Consequently, a part of the braided shield 23 is fallen into the recess grooves 36. Thus, the braided shield 23 is dug into the recess grooves 36 and the edges (or corners) of the end parts of the projection portions 40, i.e., the braided shield 23 is engaged therewith. Accordingly, the braided shield 23 is prevented from being displaced with respect to the insertion portion 35 and the press-clamping portion 32. In addition, the braided shield 23 is prevented from slipping off between the insertion portion 35 and the press-clamping portion 32.

According to the shielding terminal 3 of the configuration, the braided shield 23 can be press-clamped with a high holding force without breaking and deforming the conductor core 21 of the coaxial cable 2. Further, in a case where the shielding terminal 3 is in a half-finished state, i.e., in the case of the metal material 30, the body portion 31 is connected to the press-clamping portion 32. Thus, the number of components can be reduced. Consequently, the management cost of the components can be reduced. In addition, the configuration of the transport mechanism can be simplified by moving the transport mechanism in a state in which the body portion 31 and the press-clamping portion 32 are connected to each other.

Figure 7:
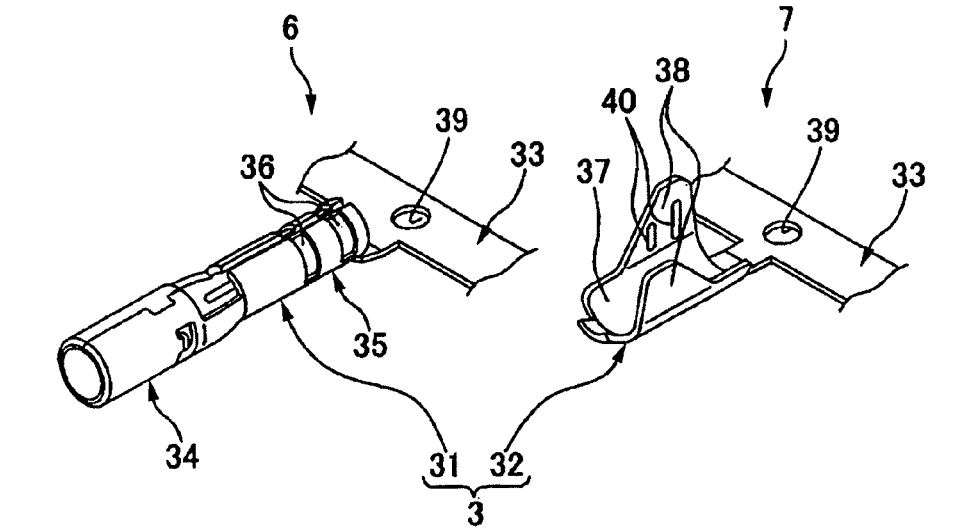
FIG. 7 is a perspective view illustrating a modification of the metal material illustrated in FIG. 3.
Figure 8:
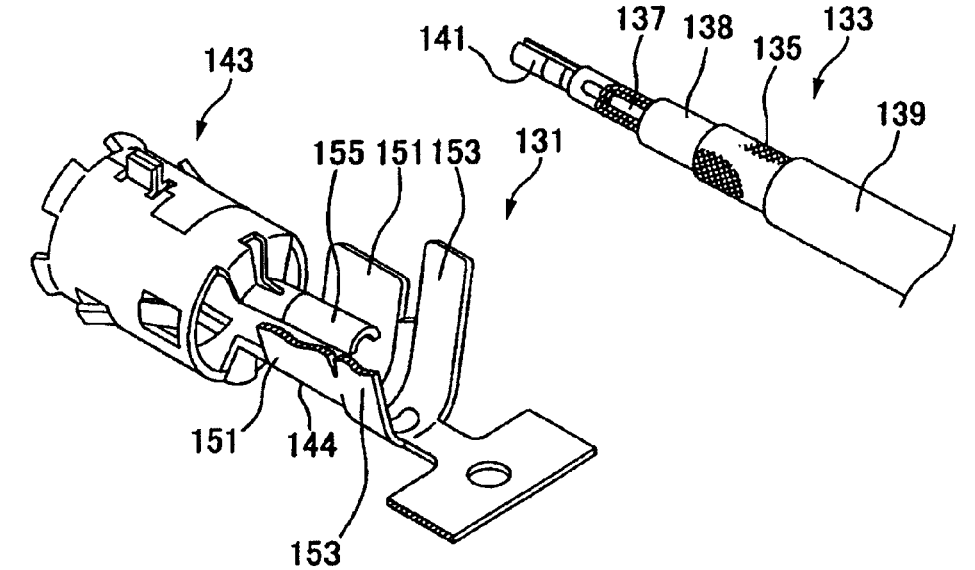
FIG. 8 (PRIOR ART)
FIG. 8 is a perspective view illustrating a conventional coaxial cable shielding terminal.

Incidentally, the shielding terminal 3 according to the invention is not necessarily formed of the metal material 30 in which the body portion 31 and the press-clamping portion 32 are connected to each other. The shielding terminal 3 can be formed using a metal material 6 in which the body portion 31 is connected to the carrier 33, and a metal material 7 in which the press-clamping portion 32 is connected to the carrier 33, by providing the metal materials 6 and 7 separately from each other, as illustrated in FIG. 7.

Further, the recess grooves 36 and the projection portions 40 are provided on both the outer surface of the insertion portion 35 and the inner surface of the press-clamping piece 38 in the embodiment such that the recess grooves 36 engage with the projection portions 40, respectively. However, it is sufficient for the shielding terminal according to the invention that the recess groove 36 or the projection 40 is provided on at least one of the outer surface of the insertion portion 35 and the inner surface of the press-clamping piece 38. Thus, the braided shield 23 is engaged with the recess groove 36 or with the edge (or corner) of each groove 36 or with the edge (or corner) of the end part of the projection portion 40. Consequently, the braided shield 23 is prevented from being displaced with respect to the insertion portion 35 and the press-clamping portion 32. In addition, the braided shield 23 is prevented from slipping off between the insertion portion 35 and the press-clamping portion 32.

Additionally, in the exemplary embodiment, the recess grooves 36 are provided on the outer surface of the insertion portion 35, and the projection portions 40 are provided on the inner surface of the press-clamping piece 38. However, the recess grooves 36 may instead be provided on the inner surface of the press-clamping piece 38, and the projection portions 40 may be provided on the outer surface of the insertion portion 35.

Incidentally, the embodiment is only an exemplary embodiment of the invention. The invention is not limited thereto. That is, the invention can be implemented by being variously modified without departing from the spirit and scope of the invention.

What is claimed is:

1. A coaxial cable shielding terminal for attaching to a coaxial cable having a conductor core which is covered by an insulating cladding, the insulating cladding being covered by a braided shield, and the braided shield being covered by an insulating sheath, the coaxial cable shielding terminal comprising:

a cylindrical inner terminal accommodating portion that accommodates an inner terminal connected to the conductor core;

an insertion portion that extends from an end of the inner terminal accommodating portion, and is inserted between the braided shield and the insulating cladding at an exposed area of the braided shield; and a press-clamping portion that is provided separately from the insertion portion, and press-clamps the exposed area of the braided shield so that the braided shield is sandwiched by the insertion portion and the press-clamping portion, wherein one of a concave portion and a convex portion is provided on an outer surface of the insertion portion;

wherein the other of the concave portion and the convex portion is provided on an inner surface of the press-clamping portion; and wherein the concave portion and the convex portion are engaged to each other to sandwich the braided shield.

2. The coaxial cable shielding terminal according to claim 1, wherein the insertion portion has a cylindrical shape.

3. The coaxial cable shielding terminal according to claim 1, wherein the one of the concave portion and the convex portion provided on the outer surface of the insertion portion extends along a circumferential direction of the insertion portion.

4. The coaxial cable shielding terminal according to claim 3, wherein:

the press-clamping portion includes a bottom plate portion and a pair of press-clamping side pieces each extending from a side edge of the bottom plate portion, and the other of the concave portion and the convex portion provided on the inner surface of the press-clamping portion is provided on at least one of the press-clamping side pieces of the press-clamping portion.

* * * * *